US009649779B2

(12) United States Patent
Lindley

(10) Patent No.: US 9,649,779 B2
(45) **Date of Patent: *May 16, 2017**

(54) EXTENDABLE VIBRATORY IMPLEMENT FOR WORKING CONCRETE

(71) Applicant: Joseph W Lindley, Paducah, KY (US)

(72) Inventor: Joseph W Lindley, Paducah, KY (US)

(73) Assignee: JLIN Corporation, Paducah, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/216,054

(22) Filed: Jul. 21, 2016

(65) Prior Publication Data

US 2016/0325465 A1 Nov. 10, 2016

Related U.S. Application Data

(63) Continuation of application No. 14/944,755, filed on Nov. 18, 2015, which is a continuation of application No. 14/204,115, filed on Mar. 11, 2014, now Pat. No. 9,212,459.

(60) Provisional application No. 61/779,055, filed on Mar. 13, 2013.

(51) Int. Cl.

| | |
|---|---|
| ***E01C 19/28*** | (2006.01) |
| ***E01C 19/43*** | (2006.01) |
| ***B28B 11/08*** | (2006.01) |
| ***E04G 21/06*** | (2006.01) |

(52) U.S. Cl.

CPC ..... *B28B 11/0818* (2013.01); *B28B 11/0809* (2013.01); *B28B 11/0881* (2013.01); *E01C 19/281* (2013.01); *E01C 19/43* (2013.01); *E04G 21/06* (2013.01)

(58) Field of Classification Search

CPC ..... E01C 19/43; E01C 19/281; E04G 21/06; B28B 11/0818; B28B 11/0809; B28B 11/0881

USPC ..... 404/93, 117, 122, 131, 124, 112, 113, 404/118

See application file for complete search history.

(56) References Cited

U.S. PATENT DOCUMENTS

| | | | | |
|---|---|---|---|---|
| 3,119,314 | A | 1/1964 | Schiel, Jr. | |
| 3,331,297 | A * | 7/1967 | Bettino | E01C 19/238 404/131 |
| 3,703,128 | A | 11/1972 | Fransson | |
| 3,759,481 | A | 9/1973 | Scott | |
| 3,910,738 | A | 10/1975 | Chandler et al. | |
| 4,208,151 | A * | 6/1980 | Cross | E01C 19/262 172/518 |
| 4,702,640 | A | 10/1987 | Allen | |
| 4,735,567 | A | 4/1988 | Frakes | |
| 5,022,783 | A | 6/1991 | Jones | |
| 5,033,906 | A | 7/1991 | Jordan | |
| 5,215,402 | A | 6/1993 | Stowell et al. | |
| 5,228,799 | A | 7/1993 | Sondreal | |
| 5,421,670 | A | 6/1995 | Meirick | |

(Continued)

*Primary Examiner* — Abigail A Risic

(74) *Attorney, Agent, or Firm* — Barnes & Thornburg LLP

(57) ABSTRACT

An imprint roller comprises a roller assembly, a frame, and a motor assembly. The roller assembly is supported on the frame and includes a vibrator head and a roller tube having a roller surface. An operator of the imprint roller may grip the frame and support at least a portion of the frame during operation of the imprint roller. The motor assembly is supported on the frame and operable to transfer mechanical energy through the frame to the vibrator head included in the roller assembly.

18 Claims, 6 Drawing Sheets

(56) References Cited

U.S. PATENT DOCUMENTS

| | | | | |
|---|---|---|---|---|
| 5,594,427 | A | 1/1997 | Kim et al. | |
| 5,803,656 | A * | 9/1998 | Turck | E04F 21/241 404/103 |
| 5,846,176 | A | 12/1998 | Zieger et al. | |
| 6,402,425 | B1 * | 6/2002 | Paladeni | E04F 21/248 404/103 |
| 7,097,384 | B2 | 8/2006 | Lindley | |
| 7,140,804 | B2 | 11/2006 | Gregg | |
| 7,153,058 | B2 | 12/2006 | Lindley | |
| 7,651,296 | B2 * | 1/2010 | Lindley | E04F 21/242 404/114 |
| 8,297,878 | B2 * | 10/2012 | Goodman | E01C 19/236 404/119 |
| 2003/0068201 | A1 | 4/2003 | Wynings | |
| 2005/0069385 | A1 | 3/2005 | Quenzi et al. | |
| 2006/0257208 | A1 | 11/2006 | Gregg | |
| 2007/0154260 | A1 * | 7/2007 | Lindley | E04F 21/242 404/114 |
| 2007/0201302 | A1 * | 8/2007 | Lindley | E01C 19/402 366/123 |
| 2008/0253221 | A1 | 10/2008 | Lindley | |
| 2011/0299924 | A1 * | 12/2011 | Stephens | E01C 7/35 404/75 |
| 2012/0251241 | A1 | 10/2012 | Sperfslage | |
| 2013/0170908 | A1 * | 7/2013 | Lindley | E01C 19/43 404/117 |

* cited by examiner

EXTENDABLE VIBRATORY IMPLEMENT FOR WORKING CONCRETE

CROSS-REFERENCE TO RELATED U.S. APPLICATION

This application is a continuation of U.S. application Ser. No. 14/944,755, filed Nov. 18, 2015, which is a continuation of U.S. application Ser. No. 14/204,115, filed Mar. 11, 2014, which issued as U.S. Pat. No. 9,124,459-B2 on Dec. 15, 2015, and which claims priority under 35 U.S.C. §119(e) to U.S. Provisional Patent Application Ser. No. 61/779,055, filed Mar. 13, 2013, each of which are expressly incorporated by reference herein.

BACKGROUND

The present disclosure relates to a method and apparatus for stamping concrete with a mold to develop a pattern in the surface of the concrete. More specifically, the present disclosure relates to a vibratory device and a method of using the device that imparts a force to a mold positioned on the surface of the concrete to imprint the surface of the concrete.

Stamping concrete stretches the surface to make an imprint in the surface of the concrete or other imprintable materials, for example, polymer concrete. Stamping includes the use of a mold, sometimes the mold is a form or system of forms, which is acted on by manually tamping the mold into the surface of the concrete to make the imprint. Generally, force is applied to the mold by manually tamping on the mold. Timing of the application of the tamping force is critical, as it must occur during the curing process of the concrete at a time when there is sufficient moisture in the concrete to fill the voids created by the molds. However, if the concrete is too dry, the imprint will result in cracking of the surface of the concrete which is undesirable and not acceptable.

Mechanical devices such as a vibrating plate and roller tampers are used for tamping and compacting soil and gravels. Such devices are too heavy or large for all concrete imprinting. For example, such devices are too heavy to be used on concrete stamping forms of the type that are used to imprint uncured concrete. Such devices are too large to be used in the areas where stamped concrete is normally desired, such as patios, sidewalks and the like. In addition, the magnitude of the vibration of traditional vibrating plate or rolling tampers cannot be controlled to the extent necessary to prevent damage to the concrete surface during the stamping process.

SUMMARY

The present application discloses one or more of the features recited in the appended claims and/or the following features which, alone or in any combination, may comprise patentable subject matter:

According to a first aspect of the present disclosure, an imprint roller comprises a frame, a roller assembly, and a motor assembly. The roller assembly is coupled to the frame. The roller assembly includes a vibrator head and a roller tube having a roller surface. The motor assembly is coupled to the frame and operable to transfer mechanical energy through the frame to the vibrator head. The roller surface includes a mold having a pattern for imprinting a concrete surface. In some embodiments, the mold is coated in an elastomeric material.

According to a second aspect of the present disclosure, an imprint roller comprises an elongated frame, a roller assembly, and a motor assembly. The elongated frame has a first end and a second end opposite the first end. The roller assembly is coupled to the first end of the frame. The roller assembly includes a vibrator head and a roller tube having a roller surface. The motor assembly is coupled to the second end of the frame and is operable to transfer mechanical energy through the frame to the vibrator head. A weight of the motor assembly is supported by a user of the imprint roller.

According to a third aspect of the present disclosure, an imprint roller comprises a frame, a roller assembly, a motor assembly, and a frame extension. The frame has a first end and a second end opposite the first end. The roller assembly is configured to be removeably coupled to the first end of the frame. The roller assembly includes a vibrator head and a roller tube having a roller surface. The motor assembly is configured to be removeably coupled to the second end of the frame and operable to transfer mechanical energy through the frame to the vibrator head. The frame extension has a first end and a second end opposite the first end. The first end of the frame extension is configured to be removeably coupled to one of the roller assembly and the second end of the frame. The second end of the frame is configured to be removeably coupled to one of the motor assembly and the first end of the frame.

In some embodiments, the first end of the frame extension is coupled to the roller assembly and the second end of the frame extension is coupled to the first end of the frame.

In some embodiments, the first end of the frame extension is coupled to the second end of the frame and the second end of the frame extension is coupled to the motor assembly.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 7 is a partially exploded view of the imprint roller of FIG. 2;

DETAILED DESCRIPTION

Figure 1:
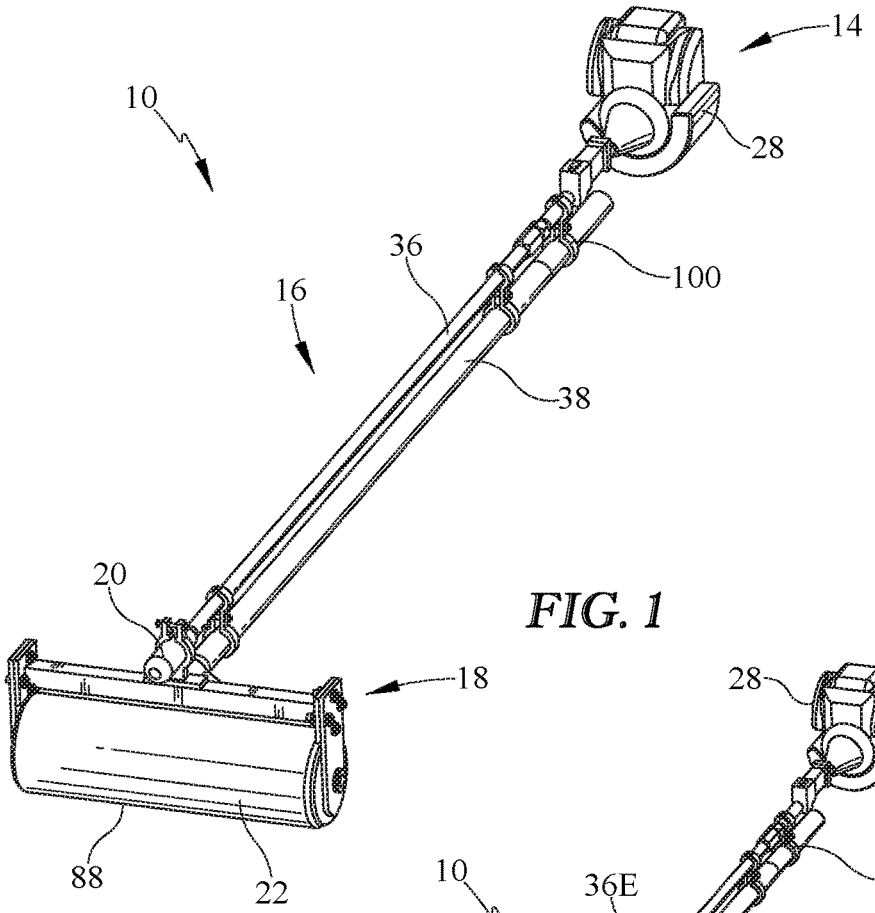
FIG. 1 is a perspective view of an imprint roller in accordance with the present disclosure used to apply a mechanical vibratory force to a surface of concrete that is curing to form an imprint of a pattern in the surface of the concrete, the imprint roller including a frame, a motor assembly coupled to a first end of the frame, and a roller assembly coupled to a second end of the frame.
Figure 2:
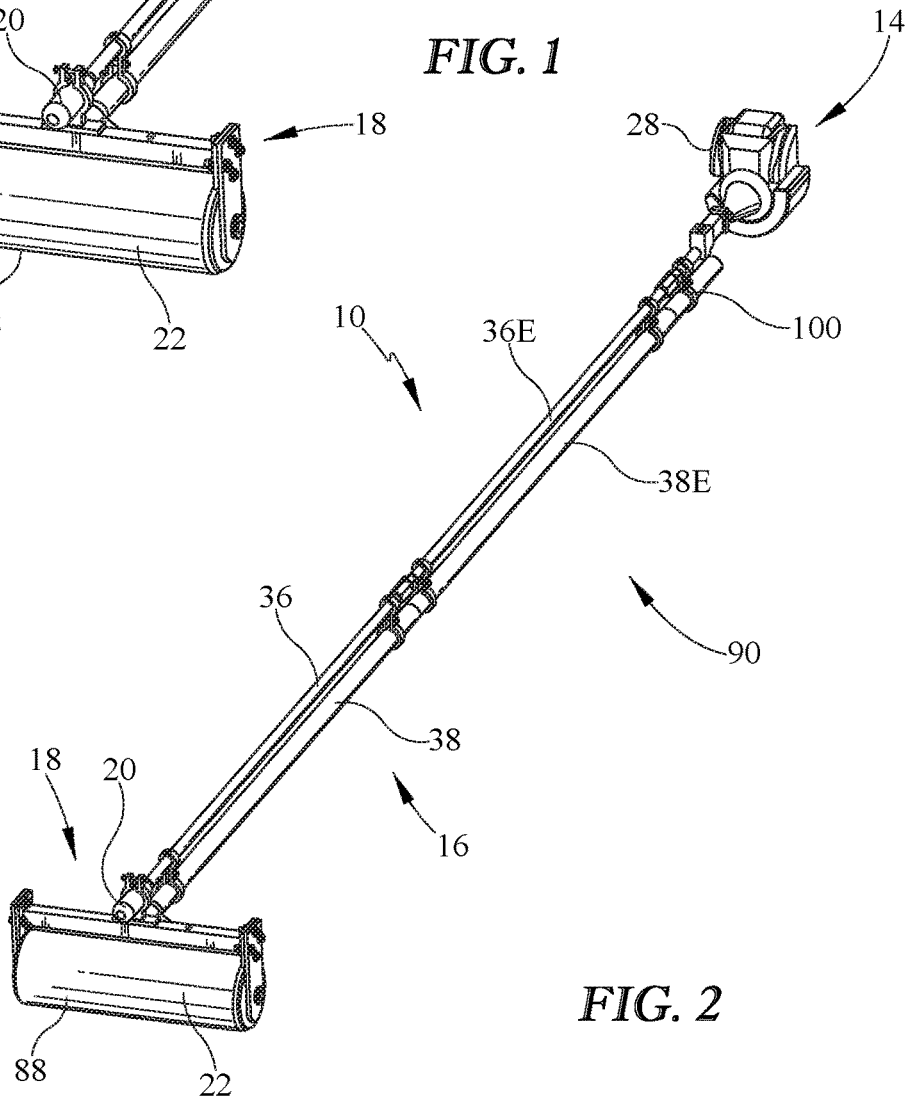
FIG. 2 is a perspective view of the imprint roller of FIG. 1 with a frame extension coupled to the frame between the motor assembly and the roller assembly to increase the total length of the imprint roller.

An imprint roller 10 is controlled by an operator 12 to apply an imprint of a pattern to a surface of concrete that is curing. Referring now to FIG. 1, imprint roller 10 includes a motor assembly 14 which is releaseably coupled to a frame 16. In some embodiments, frame 16 is an elongated frame 16. Imprint roller 10 also includes a roller assembly 18 releasably coupled to the frame 16. Operator 12 controls the operation of a motor 28 included in the motor assembly 14 so that mechanical energy is transferred from motor 28 through frame 16 to a vibrator head 20 and ultimately to a roller surface 22 of the roller assembly 18 so that the imprint of the pattern is transferred to the surface of the concrete. In some embodiments, a frame extension 90 is added to frame 16 to extend the frame 16 and increase the length of the imprint roller 10 as shown in FIG. 2. Frame extension 90 may be added to frame 16, for example, when user 12 needs to imprint a concrete surface that is located at a distance that cannot be reached with imprint roller 10 without frame extension 90.

Operator 12 controls the speed of motor 28 which controls the speed of a vibrator 24 included in vibrator head 20 which thereby controls the magnitude of vibration of vibrator head 20. Motor 28 is illustratively embodied as an internal combustion engine, but may be an electric motor in other embodiments. In some embodiments, the electric motor may be powered by an AC power source through a power cord (not shown). In other embodiments, the electric motor may be powered by a battery supported on frame 16 or integral to motor 28.

Imprint roller 10 is modularly constructed with roller assembly 18 releasably secured to a first end 26 of frame 16. Motor assembly 14 is releasably secured to a second end 32 of frame 16.

Frame 16 includes a cable drive 36 and a handle pipe 38. Cable drive 36 is configured to transfer mechanical energy from motor assembly 14 to vibrator head 20. Cable drive 36 includes a drive-cable pipe 40, a drive cable 42 positioned inside drive-cable pipe 40, and vibrator head 20. A first end 58 of drive-cable pipe 40 is configured to couple to a cable-pipe interface 48 included in motor assembly 14. A second end 60 of drive-cable pipe 40 is configured to couple to a pipe interface 62 included in vibrator head 20. A first end 52 of drive cable 42 is coupled to an output drive 50 included in motor assembly 14. A second end 54 of drive cable 42 is coupled to an input drive 56 included in vibrator head 20. Drive cable 42 is free to rotate inside drive-cable pipe 40. As such, drive cable 42 is configured to transfer mechanical energy received from output drive 50 included in motor assembly 14 to input drive 56 included in vibrator head 20 to energize vibrator 24 to cause vibrator 24 to vibrate.

Handle pipe 38 provides structural support for imprint roller 10. Handle pipe 38 has a stiffness such that handle pipe remains about straight when supporting motor assembly 14 and roller assembly 18. Drive cable 42 is free to rotate within drive-cable pipe 40 with minimum wear because handle pipe 38 assists drive-cable pipe 40 to remain straight. Handle pipe 38 is configured to be gripped by user 12 as a handle while user 12 uses imprint roller 10.

Handle pipe 38 includes a first end 68 configured to be removeably coupled to a handle interface 74 included in frame interface 72 included in motor assembly 14 and a second end 70 configured to be removeably coupled to a frame terminal 86 included in roller assembly 18. A number of clamps 100 couple handle pipe 38 to drive-cable pipe 40.

Figure 3:
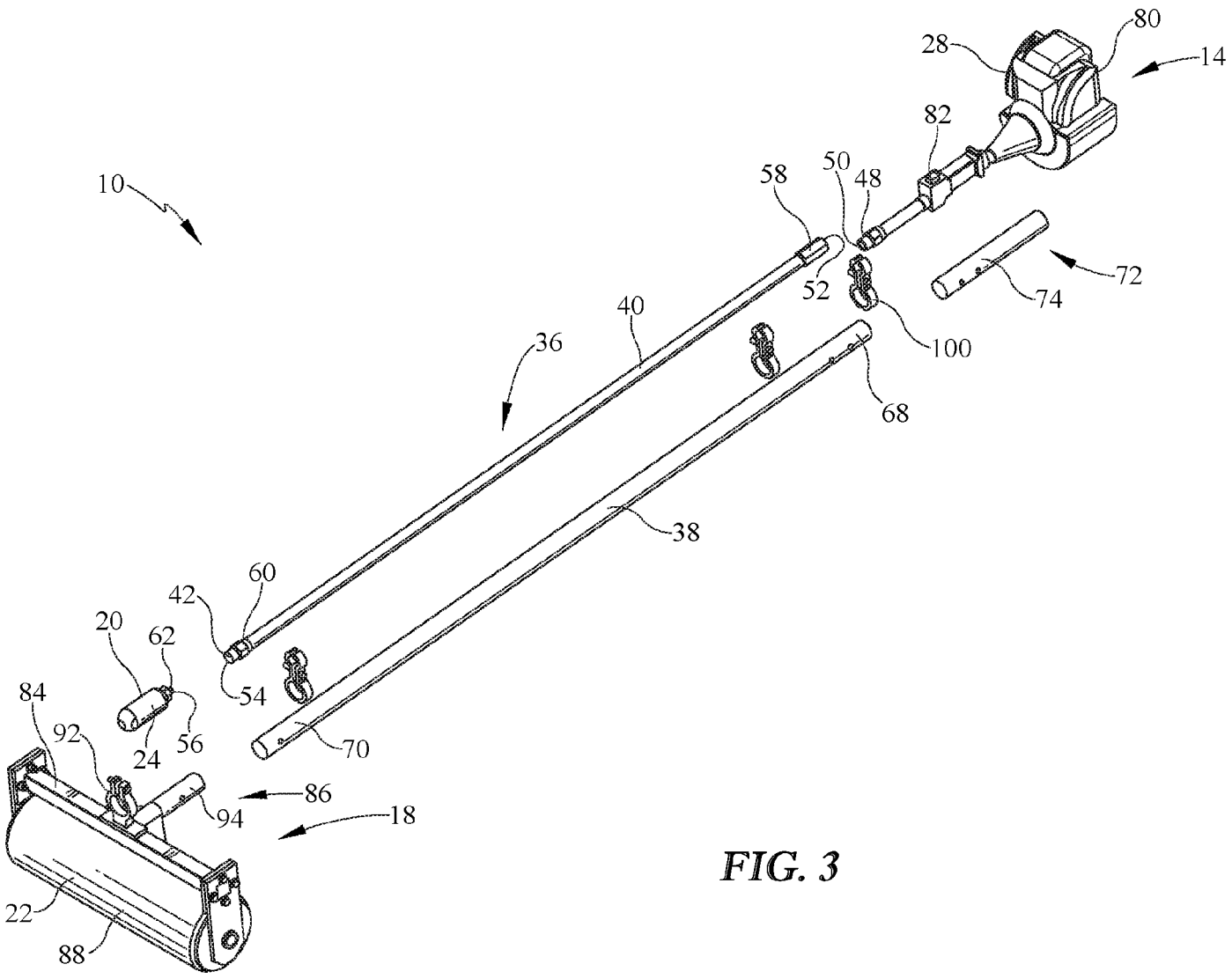
FIG. 3 is an exploded view the imprint roller of FIG. 1 revealing the components of the imprint roller.

Referring now to FIG. 3, motor assembly 14 includes motor 28 and frame interface 72 coupled to motor 28. Motor 28 includes a prime mover 80, throttle 82, and output drive 50. Prime move 80 is configured to produce mechanical energy. Throttle 82 is configured to control the magnitude of the mechanical energy and thus the magnitude of the mechanical energy delivered to vibrator 24. Output drive 50 is coupled to prime mover 80 and first end 52 of drive cable 42 and configured to transfer the mechanical energy produced by prime mover 80 to drive cable 42.

Frame interface 72 includes cable-pipe interface 48 and handle interface 74 coupled to cable-pipe interface 48 as shown in FIG. 3. Cable-pipe interface 48 is configured to be removeably coupled to first end 58 of drive-cable pipe 40. Handle interface 74 is configured to be removeably coupled to first end 68 of handle pipe 38.

Motor assembly 14 is coupled to frame 16 opposite roller assembly 18. Handle pipe 38 is configured to be gripped by user 12 when user 12 is using imprint roller 10. As such, a portion of a weight of the motor assembly 14 is supported by user 12 when user 12 is using the imprint roller 10. As motor assembly 14 is coupled to frame 16 opposite roller assembly 18, motor assembly 14 is positioned above roller assembly 18 and imparts a moment to user 12 when user 12 is using imprint roller 10.

Figure 4:
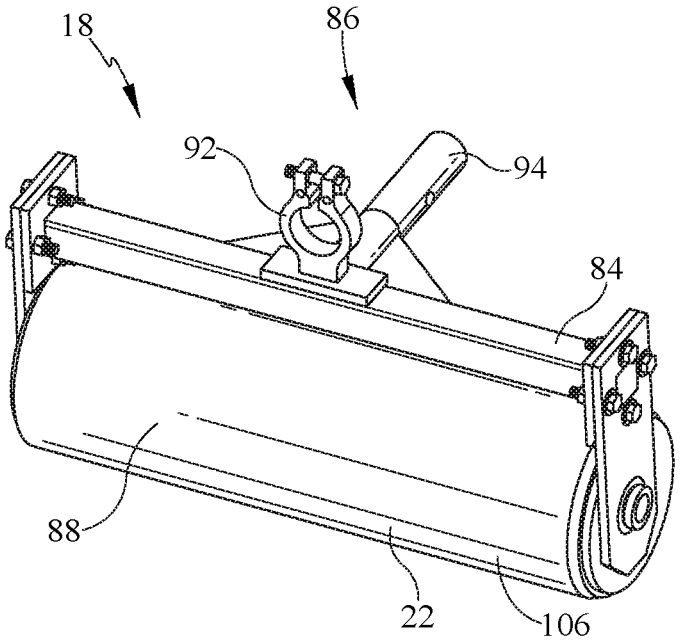
FIG. 4 is a perspective view of the roller assembly included in the imprint roller of FIG. 1.
Figure 5:
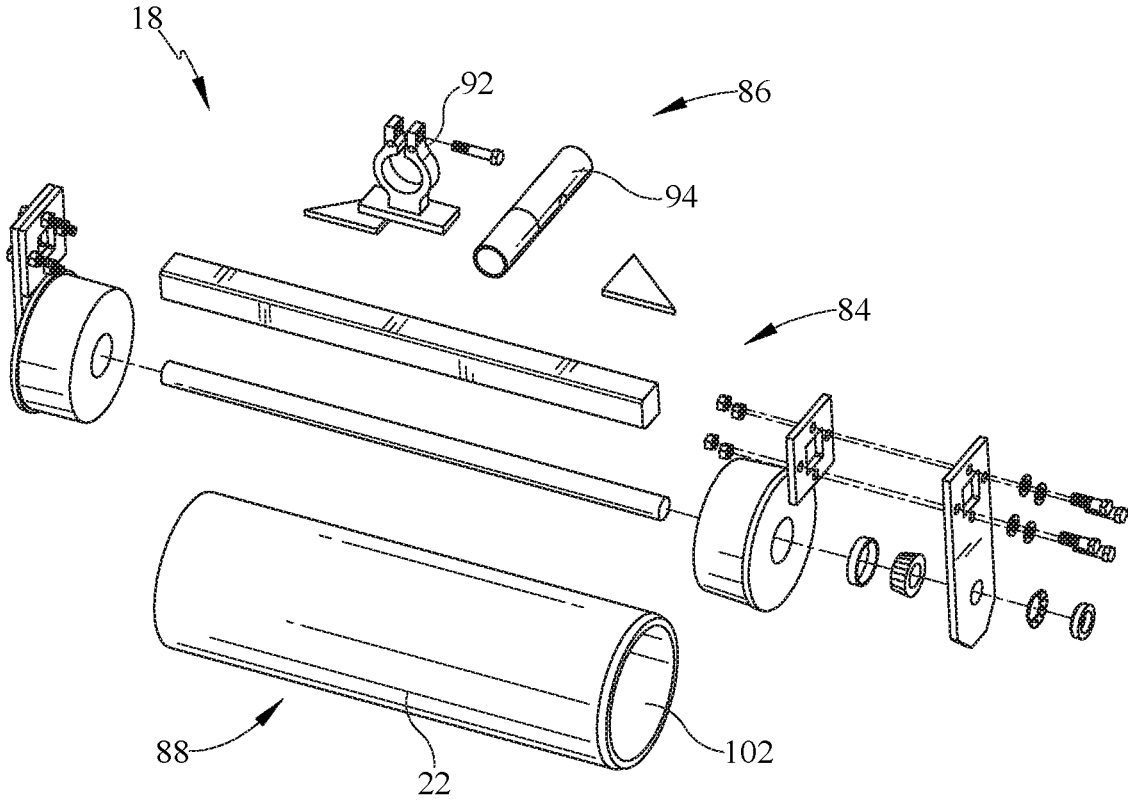
FIG. 5 is an exploded view of the roller assembly included in the imprint roller of FIG. 1 revealing the components of the roller assembly.

Refereeing now to FIG. 4, roller assembly 18 is configured to imprint a pattern to the surface of curing concrete by rolling a mold over the concrete as the vibrator head 20 imparts a vibration to the roller assembly 18. Roller assembly 18 includes a roller frame 84, a frame terminal 86 coupled to the roller frame 84, and a roller tube 88 coupled to roller frame 84.

Roller frame 84 provides structural support for supporting roller assembly 18 on frame 16 and for allowing roller tube 88 to be free to rotate. Frame terminal 86 is configured to be removeably coupled to frame 16 so that roller assembly 18 is removeably coupled to frame 16. Frame terminal 86 includes a vibrator head clamp 92 and a handle-pipe joint 94. Handle-pipe joint 94 is removeably coupled to second end 70 of handle pipe 38. Vibrator head clamp 92 is configured to clamp vibrator head 20 to roller assembly 18 such that when vibrator head 20 vibrates, the vibration is transferred to roller assembly 18.

Roller tube 88 is configured to be removeably coupled to roller frame 84 such that it is free rotate about an axis of rotation. Roller tube 88 includes a drum 102 and a roller surface 22 coupled to the circumference of drum 102.

Figure 6:
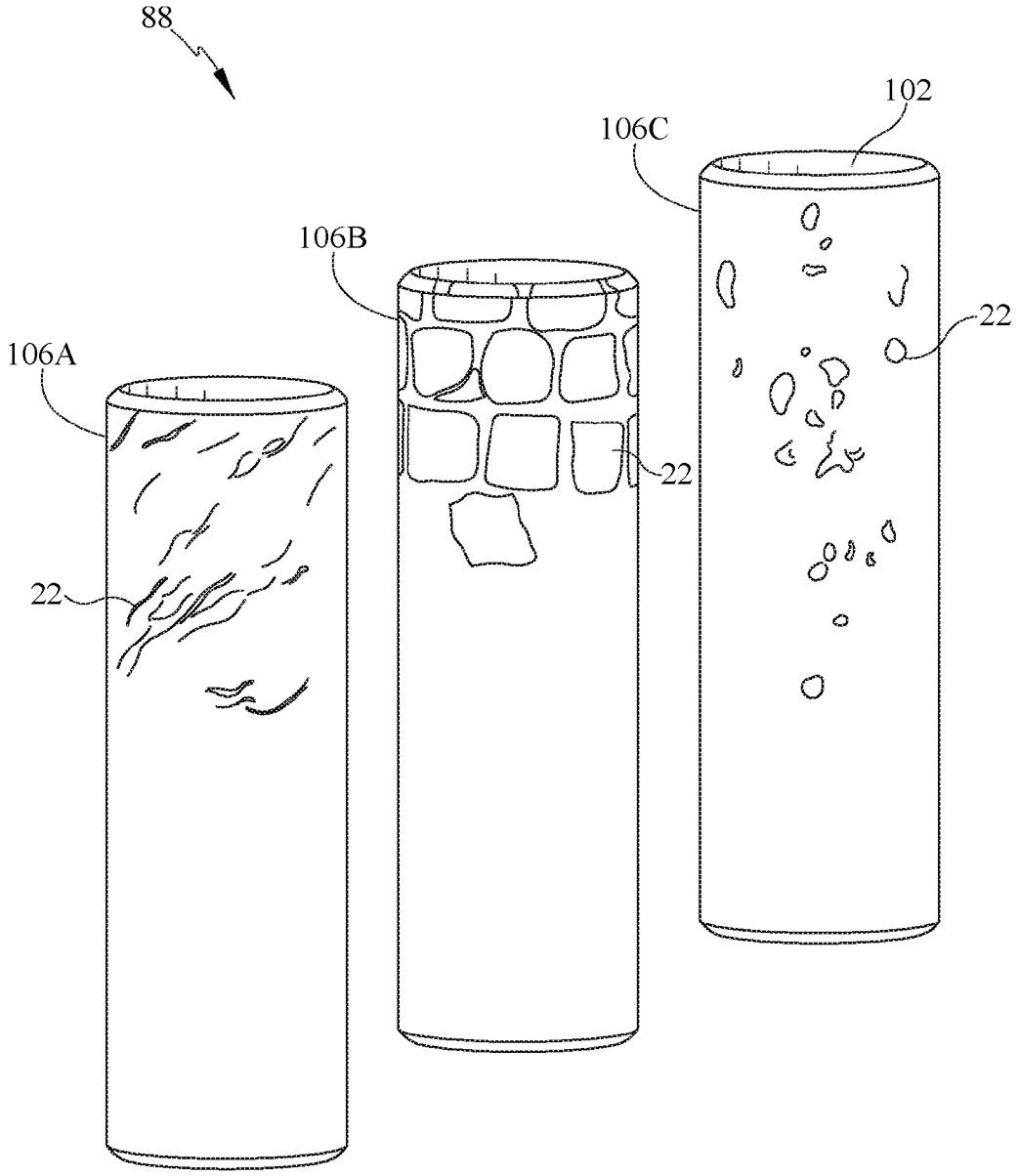
FIG. 6 is a perspective view of a number of different roller tubes included in the roller assembly, each roller tube having a mold of a different pattern on a roller surface of the roller tube.

Roller surface 22 includes a mold 106 having a pattern. The pattern may be one of any number of patterns. As shown in FIG. 6, roller surface 22 may include a mold 106A with a slate pattern, a mold 106B with a cobblestone pattern, or a mold 106C with a stone pattern. In some embodiments, an elastomeric material is coated on roller surface 22. In some embodiments, the elastomeric material is polyurethane. As roller tube 88 is removebly coupled to roller frame 84, user 12 may interchange roller tubes 88 to a roller tube 88 having mold 106 with a desired pattern. For example, user 12 may change roller tube 88 having mold 106A with a slate pattern for roller tube 88 having mold 106B with a stone pattern.

In some embodiments, imprint roller 10 includes at least one frame extension 90 as shown in FIG. 2. Frame extension 90 is similar to frame 16. Frame extension 90 includes a cable drive 36E and a handle pipe 38E. Frame extension 90 is configured to be removeably coupled between frame 16 and motor assembly 14 or between frame 16 and roller assembly 18. As such, when frame extension 90 is coupled to frame 16, frame extension 90 increases the length of imprint roller 10. Imprint roller 10 may include a number of frame extensions 90. In the illustrative embodiment, imprint roller 10 includes one frame extension 90 located between frame 16 and motor assembly 14 as shown in FIG. 2.

Figures 7A, 7B, 7C:
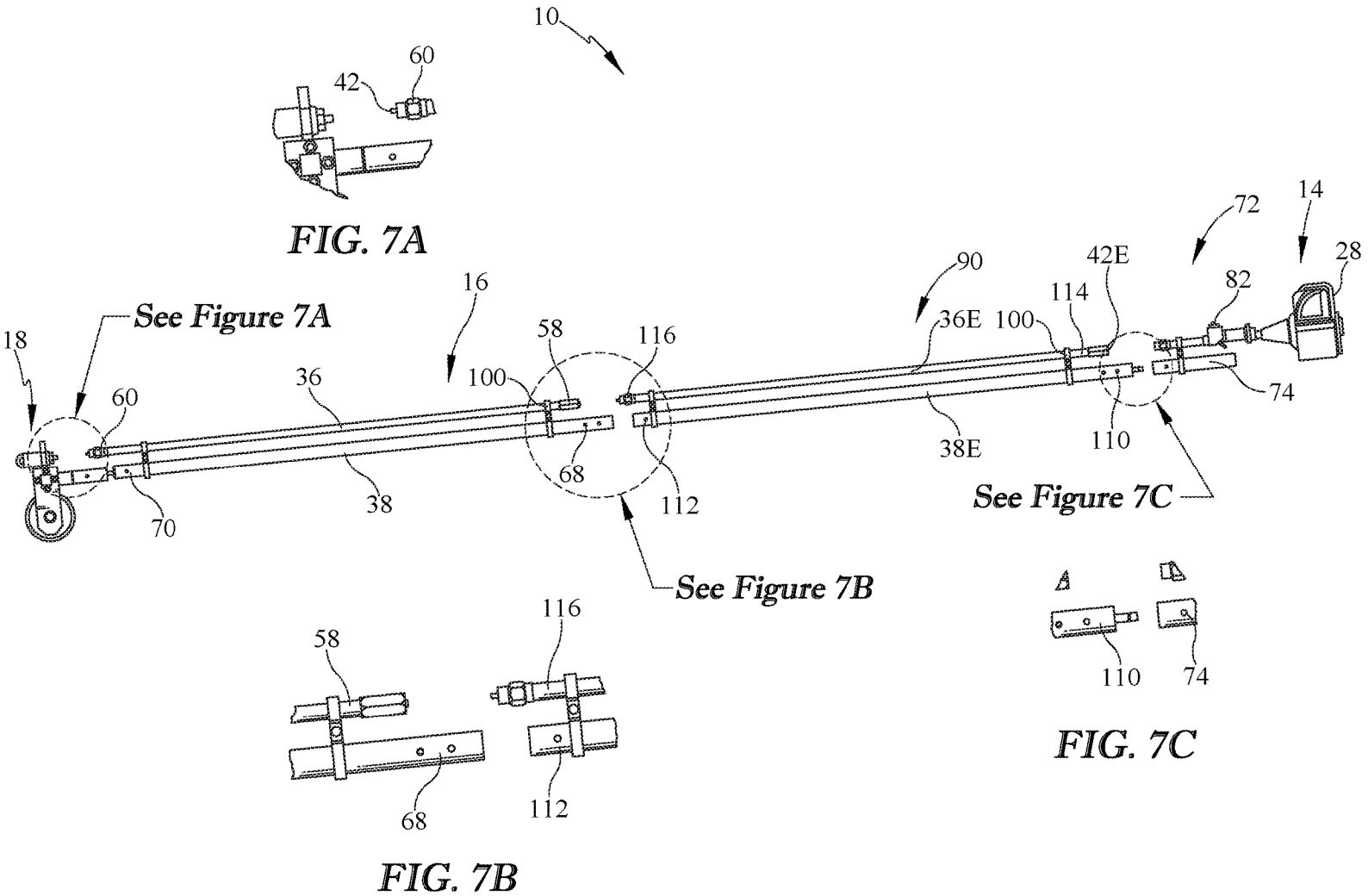
FIG. 7*a* is an enlarged view of a portion of the imprint roller of FIG. 7 shown in the circle marked 7*a* in FIG. 7.
FIG. 7*b* is an enlarged view of a portion of the imprint roller of FIG. 7 shown in the circle marked 7*b* in FIG. 7.
FIG. 7*c* is an enlarged view of a portion of the imprint roller of FIG. 7 shown in the circle marked 7*c* in FIG. 7.
Figure 8A:
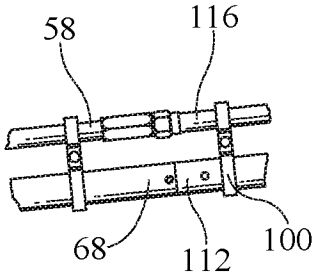
FIG. 8*a* is an enlarged view of a portion of the imprint roller shown in the circle marked 8*a* of FIG. 8.
Figure 8:
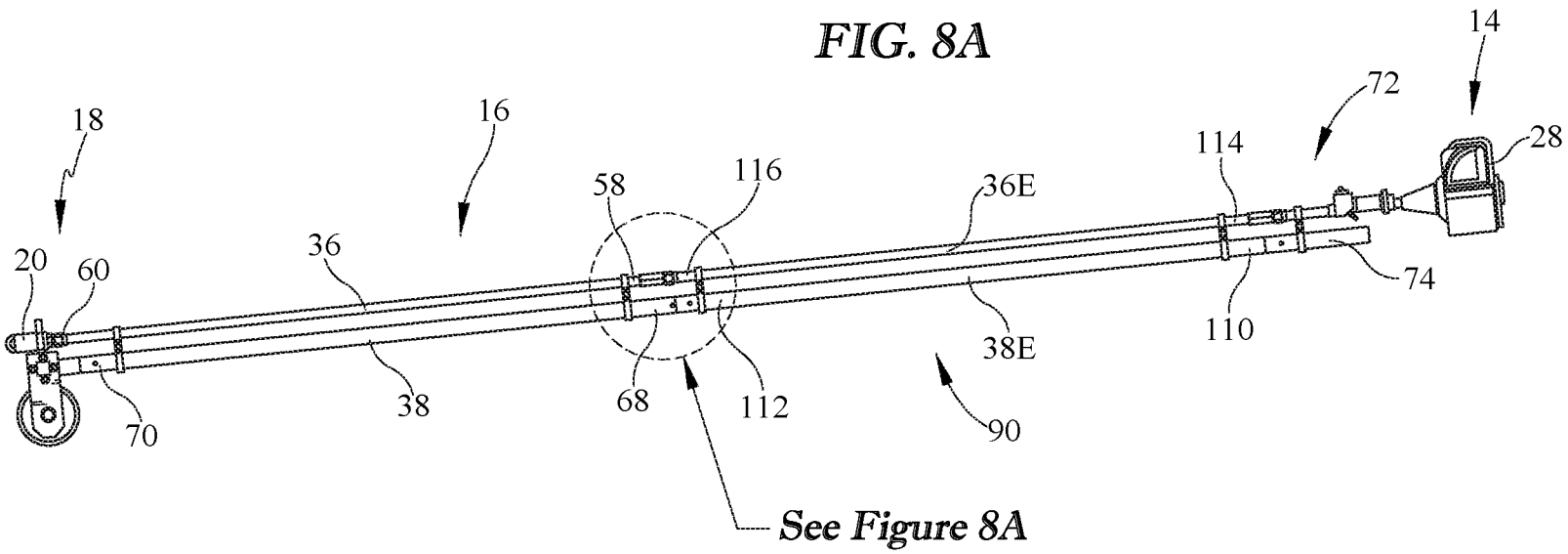
FIG. 8 is a side elevation view of the imprint roller of FIG. 8.

As shown in FIGS. 7 and 8, handle pipe 38E includes a first end 110 configured to be removeably coupled to motor assembly 14 and a second end 112 configured to be removeably coupled to first end 68 of handle pipe 38. In some embodiments first end 110 is also configured to be removably coupled to second end 70 of handle pipe 38. In some embodiments, second end 112 is configured to be removeably coupled to roller assembly 18.

Cable drive 36E includes at least a drive-cable pipe 40E. In some embodiments, cable drive 36E includes a drive cable 42E that is longer than drive cable 42 and configured to replace drive cable 42 when frame extension 90 is included in imprint roller 10. Drive-cable pipe 40E includes a first end 114 configured to be removeably coupled to motor assembly 14 and a second end 116 configured to be removeably coupled to first end 58 of drive-cable pipe 40. In some embodiments first end 114 is configured to be removably coupled to second end 60 of drive-cable pipe 40. In some embodiments, second end 116 is configured to be removeably coupled to roller assembly 18. In the illustrative embodiment, handle pipe 38E and cable drive 36E are coupled together by clamps 100.

In use, the pattern of mold 106 of roller tube 88 is formed on a concrete slab quickly and consistently with use of imprint roller 10. The uncured concrete slab is poured and finished to form a surface at a final grade. Operator 12 selects a vibratory speed of vibrator 24 which is effective to cause the pattern of mold 106 to imprint the surface of the concrete with the pattern. Operator 12 progressively moves imprint roller 10 to roll roller tube 88 over the surface of the concrete. Moving imprint roller 10 back and forth over the surface of the concrete with a consistent oscillatory motion, operator 12 progressively stamps the desired pattern of mold 106 into the surface of the concrete. Imprint roller 10 is moved progressively across the surface of the concrete as the slab cures.

The speed of vibrator 24 is varied depending on changing conditions of the slab to provide a consistent pattern across the slab. Completed portions of the pattern may be colored or further finished by operator 12 or assistants to the operator 12.

Although certain illustrative embodiments have been described in detail above, variations and modifications exist within the scope and spirit of this disclosure as described and as defined in the following claims.

The invention claimed is:

1. A vibratory device for working concrete comprising:

a frame having a first end and a second end opposite the first end, an implement configured to be removeably coupled to the first end of the frame, the implement including a vibrator head and a concrete engaging tool, the vibratory head transferring vibration to the tool, a motor assembly configured to be removeably coupled to the second end of the frame and operable to transfer mechanical energy through the frame to the vibrator head, and a frame extension having a first end and a second end opposite the first end, wherein the first end of the frame extension is configured to be removeably coupled to one of the implement and the second end of the frame, and the second end of the frame extension is configured to be removeably coupled to one of the motor assembly and the first end of the frame to change the distance between the motor assembly and the implement while transferring the mechanical energy through the frame extension; and wherein the frame extension comprises an extension drive member positioned within an extension drive member housing, wherein the extension drive member is rotatable within the extension drive member housing.

2. The vibratory device of claim 1, wherein the first end of the frame extension is coupled to the implement and the second end of the frame extension is coupled to the first end of the frame.

3. The vibratory device of claim 2, wherein the first end of the frame extension is coupled to the second end of the frame and the second end of the frame extension is coupled to the motor assembly.

4. The vibratory device of claim 2, wherein the frame comprises a drive assembly having a first end removably coupled to the vibrator head, and a second end removably coupled to the motor assembly, wherein the drive assembly transfers mechanical energy from the motor assembly to the vibrator head.

5. The vibratory device of claim 4, wherein the drive assembly comprises a drive member positioned within a drive member housing, wherein the drive member is rotatable within the drive member housing.

6. The vibratory device of claim 5, wherein the frame further comprises a handle member having a first end removably coupled to the implement, and a second end removably coupled to the motor assembly.

7. The vibratory device of claim 2, wherein the concrete engaging tool includes a mold having a pattern for imprinting a concrete surface.

8. The vibratory device of claim 7, wherein the mold is coated in an elastomeric material.

9. The vibratory device of claim 2, wherein a weight of the motor assembly is supported by a user of the vibratory device.

10. The vibratory device of claim 9, wherein the frame is an elongated frame and the elongated frame comprises a drive assembly having a first end removably coupled to the vibrator head, and a second end removably coupled to the motor assembly, wherein the drive assembly transfers mechanical energy from the motor assembly to the vibrator head.

11. The vibratory device of claim 10, wherein the drive assembly comprises a drive member positioned within a drive member housing, wherein the drive member is rotatable within the drive member housing.

12. The vibratory device of claim 11, wherein the drive member comprises a cable drive.

13. A vibratory device for working concrete comprising:

a frame having a first end and a second end opposite the first end, an implement configured to be removeably coupled to the first end of the frame, the implement including a vibrator head and a concrete engaging tool, the vibratory head transferring vibration to the tool, a motor assembly configured to be removeably coupled to the second end of the frame and operable to transfer mechanical energy through the frame to the vibrator head, and a frame extension having a first end and a second end opposite the first end, wherein the first end of the frame extension is configured to be removeably coupled to one of the implement and the second end of the frame, and the second end of the frame extension is configured to be removeably coupled to one of the motor assembly and the first end of the frame, wherein the first end of the frame extension is coupled to the implement and the second end of the frame extension is coupled to the first end of the frame, wherein the frame extension comprises an extension drive assembly having a first end removably coupled to the second end of the frame, and a second end removably coupled to the motor assembly, wherein the extension drive assembly transfers mechanical energy from the motor assembly to the vibrator head.

14. The vibratory device of claim 13, wherein the extension drive assembly comprises an extension drive member positioned within an extension drive member housing, wherein the extension drive member is rotatable within the extension drive member housing.

15. The vibratory device of claim 14, wherein the extension drive assembly is removably coupled to a drive assembly of the frame.

16. The vibratory device of claim 15, wherein the extension drive assembly and the drive assembly each comprise a cable drive.

17. The vibratory device of claim 1, wherein the extension drive assembly is removably coupled to a drive assembly of the frame.

18. The vibratory device of claim 17, wherein the extension drive assembly and the drive assembly each comprise a cable drive.

* * * * *